United States Patent [19]

Arnold

[11] 4,040,135

[45] Aug. 9, 1977

[54] EMERGENCY LOCATOR SYSTEM FOR LOCATING AND RETRIEVING SUNKEN VESSELS

[76] Inventor: Ruben Robert Arnold, 21641 Zamora Lane, Huntington Beach, Calif. 92646

[21] Appl. No.: 633,922

[22] Filed: Nov. 20, 1975

[51] Int. Cl.[2] ..... B63B 21/52

[52] U.S. Cl. ..... 9/9; 116/124 B; 294/66 R

[58] Field of Search ..... 9/9; 116/124 B; 294/66 R; 114/51

[56] References Cited

U.S. PATENT DOCUMENTS

| | | | |
|---|---|---|---|
| 2,569,977 | 10/1951 | Dickinson | 9/9 |
| 2,594,120 | 4/1952 | Busher | 294/66 R |
| 3,156,933 | 11/1964 | Brooks | 9/9 |
| 3,425,070 | 2/1969 | Clark | 9/9 |
| 3,871,044 | 3/1975 | Wedrall | 9/9 |

*Primary Examiner*—Trygve M. Blix
*Assistant Examiner*—Sherman D. Basinger
*Attorney, Agent, or Firm*—Charles A. Goodall

[57] ABSTRACT

An emergency locator system for locating and retrieving sunken vessels and vessels in distress comprising in combination a base, a buoyant float releasably mounted thereon and a long line connecting the base and float. The base is adapted to be mounted on an external surface of a vessel in spaced apart relationship thereto to permit fluid to circulate between the vessel surface and the base. The base comprises a hydrostatic pressure sensing-diaphragm activated float holding and trigger release assembly. The diaphragm is located on a lower surface of the base adjacent the vessel surface when the base is mounted on the vessel. The base has U-shaped grapple cables attached to it and the grapple cable ends may also be attached to the vessel beneath the mounted base. The float is adapted to be releasably mounted on the base and upon the base float being subjected to a pre-selected external pressure the float is released and floats to the water surface being connected to the base by a long locator line. The float has provisions for a dye marker embedded therein and a signaling system mounted on a top surface thereof or it may be provided without either of these or just one of them at the option of the user.

12 Claims, 11 Drawing Figures

FIG. 5
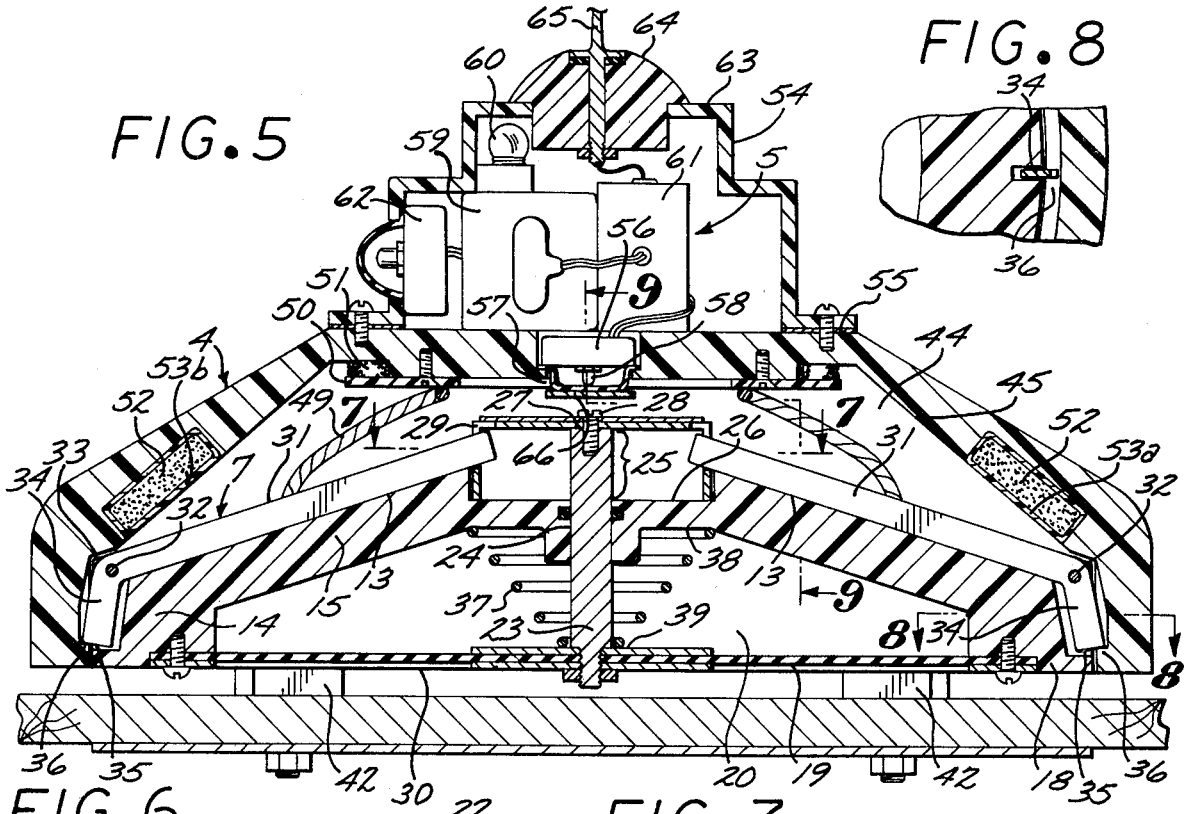
FIG. 8
FIG. 6
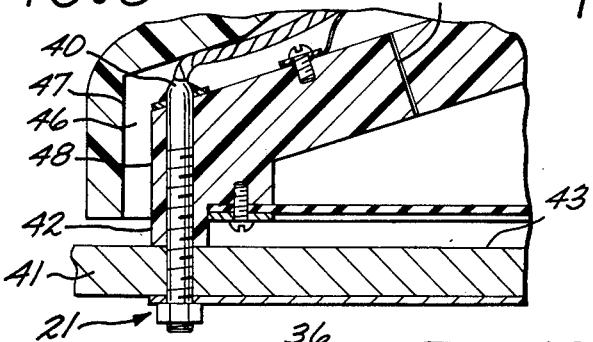
FIG. 7
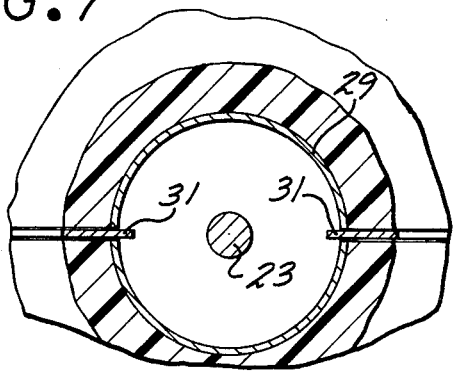
FIG. 10
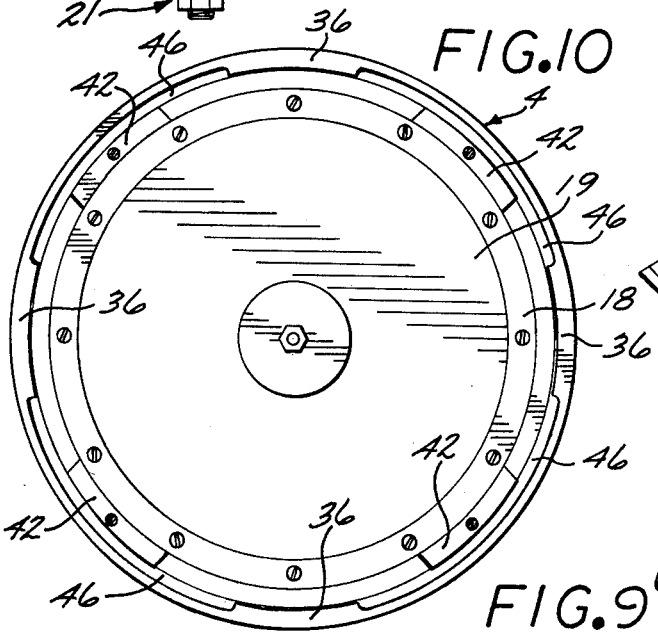
FIG. 11
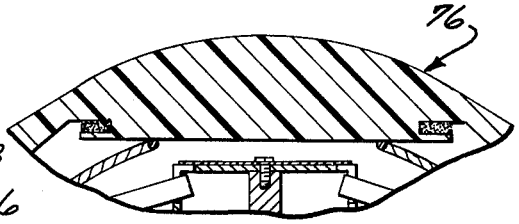
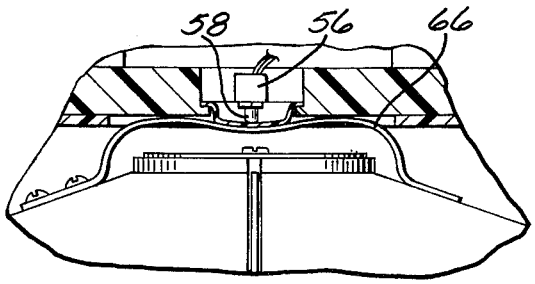
FIG. 9

EMERGENCY LOCATOR SYSTEM FOR LOCATING AND RETRIEVING SUNKEN VESSELS

BACKGROUND OF THE INVENTION

1. Field of the Invention

This invention relates generally to recovery of submerged objects and more particularly to a device for locating and retrieving a sunken vessel and for locating vessels in distress.

2. Description of the Prior Art

Marker buoy systems have been utilized for locating sunken vessels for a considerable period of time. These systems often include means for aiding the retrieval of the sunken vessel. Examples of these types of systems are disclosed in U.S. Pat. Nos. 3,156,933; 3,425,070 and 3,874,013. These devices each rely upon a ring member being lowered on locator line from a released float to the sunken vessel whereupon the ring engages with hook means for retrieving the vessel. The system disclosed in U.S. Pat. No. 3,156,933 employs a relatively complex and expensive float release activating system and requires that the float pull out of the base a cable which is attached to the vessel and has the retrieval hook means thereon. If the cable failed to be pulled from the base properly, retrieval would not be possible. The system disclosed in U.S. Pat. No. 3,425,070 would be large and bulky if adapted for vessels and particularly small craft and further presents a problem in that the door to the box could become damaged and fail to open. The device described in U.S. Pat. No. 3,879,013 while particularly adaptable to large vessels would be bulky and detract from the looks of small craft and presents mounting problems with regard to small craft.

SUMMARY OF THE INVENTION

The primary object of the present invention is to provide an Emergency Locator System for locating a vessel which has sunk in water too deep or murky to be seen from the surface by providing a float means releasably mounted on a base fixedly attached to a vessel exterior surface, said base comprising a hydrostatic pressure sensitive float release means which is activated automatically by water pressure as the boat to which the system is attached sinks in the water below a depth at which the water pressure is greater than the force required to activate the float release mechanism, there being a long line connecting the float to the base.

Another object of the invention is to provide a float as described having embedded therein a plurality of dye marker capsules having varying solubilities in water for prolonged dye marking the water surrounding the float once it is released from the vessel and is floating on the water surface.

Another object of the invention is to provide an Emergency Locator System wherein the float means contains an emergency signaling system comprising a high intensity strobe light means emitting light from the float top is an hemispheric pattern thereby providing a means for locating the vessel at night and/or in foggy weather.

Another object is to provide an Emergency Locator System having a float providing in combination a strobe light means and a VHF radio transmitter for continuously transmitting a distress signal on an international emergency frequency. The radio transmitter may also be an alternative locator without use of the light.

Another object is to provide for a connecting line between the float and the base whereby the released float may be connected to the base mounted on the sunken vessel and the line may be used for guiding a diver to the vessel for attaching a retrieval line thereto.

Another object of the invention is to provide a method for recovery of a sunken vessel once it is located employing a grapple hook means, which is fixedly connected to suitable cable, wherein the grapple hook means may be guided down to the vessel by utilizing the line connecting the float to the base of guiding the grapple hook means is the base and hooking the grapple hook into the grapple cables attached to the base and vessel.

Another object of the invention is to provide a float with a signaling means for use in the event of a radio and power failure on the vessel which is in a distressed situation on the surface.

Another object is to provide an inexpensive Emergency Locator System which may be adapted for use on small and large vessels and is simple to manufacture.

These and other objects will be apparent to one skilled in the art from the description of the preferred embodiment and the claims.

Operation of the Emergency Locator System employs a combination hydrostatic and mechanical system. The float is releasably mounted on the base and the base comprises a hollow housing having its open end sealably closed with a diaphragm. The diaphragm is mechanically connected to a float release mechanism which is activated by movement of the diaphgram when it is subjected to an increase in external pressure as the vessel sinks in the water. The diaphragm movement activates the float release mechanism and releases the float. The float spins off of a very high tensile strength long line, which is attached between the float and the base, as the float rises to the water surface. This line establishes a link between the sunken vessel and the surfaced float and thereby permanently marks the location of the sunken vessel as long as the line remains intact.

BRIEF DESCRIPTION OF THE DRAWINGS

FIG. 5 is a cross-sectional view of the Emergency Locator System with the float means mounted on the base showing the constructional features of the system and showing the system mounted on a vessel deck.

FIG. 6 is a segment of a cross-sectional view of the Emergency Locator System showing a method of attaching the grapple cables to the base and to the vessel deck and further showing a cavity pressure balancing hole in the base housing.

FIG. 7 is a cross-sectional view showing the trigger lever arms vertically pivotably mounted in the trigger activating piston.

FIG. 8 is a segment of a cross-sectional view showing a release trigger arm mounted in a base housing vertical wall and the float with the trigger arm in float locking engagement position.

FIG. 9 is a segmented of a cross-sectional view of the float showing the signaling system on-off switch over a perspective view of the central portion of the base housing top surface showing the leaf spring means for maintaining the on-off switch in "off" position while the float is mounted on the base.

FIG. 10 is a plan view of the lower surface of the assembled Emergency Locator System.

FIG. 11 is a cross-sectional view of an Emergency Locator System having a float means without the emergency signaling system.

DESCRIPTION OF THE PREFERRED EMBODIMENT

Figure 1:
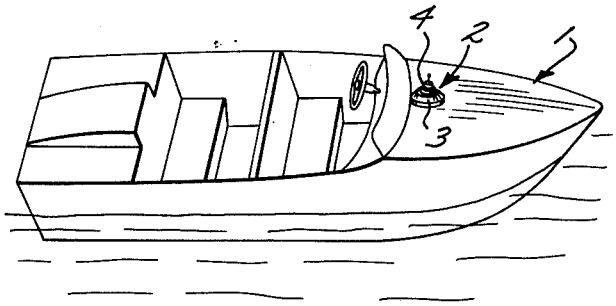
FIG. 1 is a perspective view showing a small boat in the water having an Emergency Locator System mounted on the bow deck.
Figure 2:
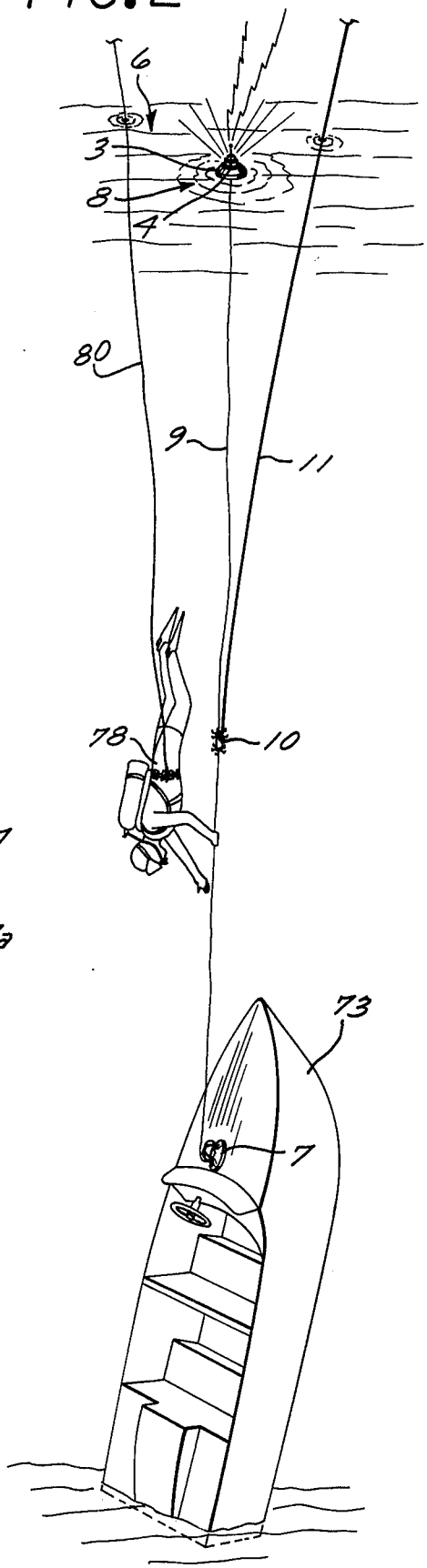
FIG. 2 is a perspective view of a sunken boat equipped with an Emergency Locator System showing the surfaced float connected by the locator line to the base and further showing a diver being guided by the locator line to the boat and also showing a grapple hook means being guided to the boat by the line as alternative methods for retrieving the boat.

Referring now to FIG. 1 — a small craft vessel represented by a motor boat 1 is shown with an Emergency Locator System 2 installed thereon. The float means 3 is visible in this figure and has included thereon a signaling system housing 4 with a signaling system 5 (see FIG. 5) mounted therein. In FIG. 2 the Emergency Locator System 2 is shown in operation. The motor boat 1 has sunk and is submerged in water 6. The float means 3 has been released from the base 7 and is floating on the water surface 8. The locator line 9 is connected between the float 3 and the base 7. A grapple hook means 10 is shown being guided down to the sunken boat having attached thereto a retrieval cable 11 for hooking into grapple cables 12 on the base. The signaling system 5 has been activated and is emitting light and transmitting a distress signal.

Figure 3:
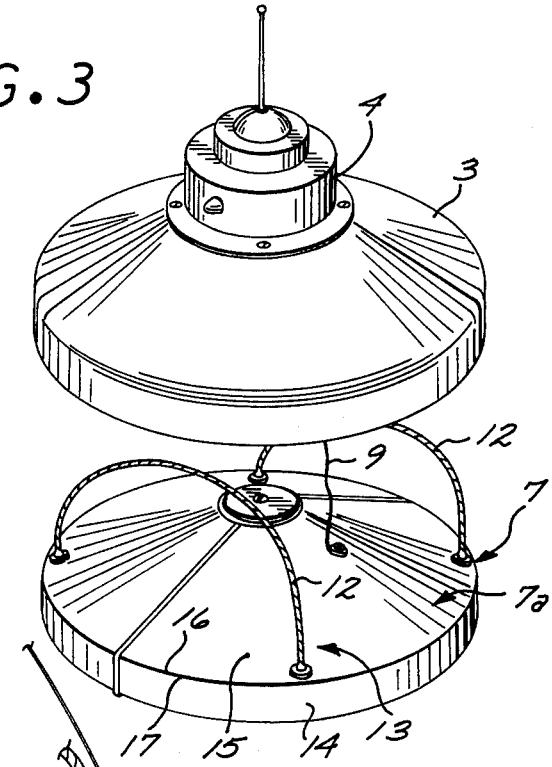
FIG. 3 is a perspective view of the Emergency Locator System showng the base and float in unmounted position.

Referring to FIG. 3 the Emergency Locator System float 3 and base 7 in position ready for mounting the float 3 on the base 7 is shown. The grapple cables 12 are shown attached to a base housing top surface 13. The base is a hydrostatic pressure sensing float holding and release means having a rigid hollow water proof housing 7*a* having a relatively short vertical cylindrical side wall 14 and a conical top wall 15. A top wall circumferential edge 16 is integral with a side wall upper edge 17. The base housing is sealably closed at a side wall lower edge 18 (FIGS. 5 and 10) with a diaphragm 19 enclosing within the housing a pressure differentiating cavity 20 (FIG. 5).

Now referring to FIGS. 5 through 10 the constructional features of the float means 3 the base 7, the signaling system 5 and the base mounting means 21 are described. There is a pressure balancing hole 22 in the conical wall for maintaining the pressure in the cavity 20 essentially equal to atmospheric pressure when the base is not submerged in water so that the float means 3 will not be released as a result of atmospheric pressure changes. The diaphragm 19 has a float release trigger actuating piston shaft 23 sealably connected thereto. The shaft 23 extends upwardly through the cavity 20 and through a piston shaft hole 24 in the conical wall. The piston shaft 23 extends a relatively short distance 25 above a conical wall top surface 26 and at a shaft top end 27 is fixedly connected by bolt means 28 to a float release trigger activating piston 29. The shaft 23 moves vertically and sealably within the shaft hole 24 when a force is applied to a diaphragm external surface 30 as a result of an increase in external pressure such as would occur if the base 7 were submerged in water. The piston 29 has vertically pivotably mounted therein a plurality of float release trigger lever arms 31. The embodiment here shows two lever arms 31, however, it may be desirable to have more than two lever arms 31 to avoid the possibility of the float 3 binding on the base 7 during the mounting of the float 3 thereon particularly with large configurations. The lever arms 31 are spaced approximately equidistantly around the piston 29. The lever arms 31 extend outwardly from the piston 29 in parallel relation to a housing top surface 13 maintaining the said equidistant arrangement. The lever arms are vertically pivotably mounted in trigger lever arm pivots 32, the pivots 32 being attached to or being integral with the housing 7*a* at or near a housing outer edge 33. The lever arms 31 have a float release trigger control member 34 extending downwardly from the pivot 32 and a trigger control member end 35 comprises a float release trigger 35. The trigger control member 34 and trigger 35 are spaced apart from the base housing wall 14 to permit movement of the trigger control member 34 and trigger 35 toward the vertical wall 14 when the diaphragm 19 moves upwardly thereby releasing the float means 3. The normal position of the trigger control member 34 and trigger 35 is as shown in locking engagement with float trigger engaging shoulder 36. A pressure depth-set spring means 37 for pre-selecting a pressure, below which the diaphragm will not activate the piston shaft upwardly, is enclosed within the cavity springingly mounted between a conical wall underside 38 and a diaphragm top surface 39 utilizing the shaft 23 and the conical wall underside 38 as a spring retaining means. The spring means 37 provides a force against the diaphragm 19 in opposition to the forces applied thereto resulting from increases in external pressure. The base 7 has attached thereto a plurality of U-shaped grapple cables 12 extending upwardly therefrom. Grapple cable ends 40 (FIG. 6) are integral with base mounting bolt means 21. The mounting bolt means 21 extend through the base vertical wall 14 and through a boat deck member 41 for boltably attaching the base 7 to the boat deck member 41. The base 7 has mounting spacer feet 42 extending downwardly from the vertical wall lower edge 18 for base-to-deck spaced apart mounting thereby permitting air and water to circulate freely between the diaphragm 19 and the boat deck surface 43.

The float means 3 shown mounted on the base 7 described above is adapted to mount loosely over the base housing 7*a* in spaced apart relationship therewith. There is a first space 44 between the housing top surface 13 and a float underside 45 and a second space 46 between the float vertical wall interior surface 47 and a housing vertical wall exterior surface 48 sufficient to permit water to freely circulate in the said spaces. The first space 44 is further sufficient to permit unimpaired operation of the float trigger release piston 29 and the lever arms 31 and further to permit the grapple cables to reside therein in bent over relationship 49 as shown. The float means 3 shown in FIG. 5 has included a locator line spool 50 centrally mounted on a float means underside 45 and a wound locator line 51 is shown wound thereon. There is also embedded in the float means underside 45 a plurality of dye marker capsules 52 having encapsulating walls 53*a* and 53*b* having different thicknesses. The encapsulating walls 53*a*, 53*b* are of water soluble material and the varying wall thicknesses between each of the plurality of capsules is to provide for continuous dye marking of the water when the float is in the water over a relatively long period of time. The float means 3 shown in FIG. 5 further has an Emergency Locator System signaling system 5 mounted in a signaling system housing 54. The housing 54 is sealably mounted on a float means top surface 55 and the housing 54 sealably encloses the signaling system 5 therewithin. An on-off push button switch 56 is sealably mounted in a float means underside center portion 57. The switch 56 is in an "off" position as shown when the button 58 is depressed. The button 58 is spring actuated and when not held in a depressed position (as shown), the button 58 extends outwardly and the switch 56 is thereafter while in such position held in an "on" position thereby electrically connecting the signaling system 5 to a battery pack 59. The signaling system shown provides for a strobe light means 60 and a distress signal generating radio transmitter means 61 for continuously transmitting an internationally recognized distress signal on a recognized distress frequency. The signaling system further provides a manually controled on-off switch 62 which may be used to electrically test the signaling system or for energizing the signaling system for use in an emergency even though the vessel has not sunk. The housing 54 has sealably mounted in a signaling system housing top wall 63 a substantially hemispherical strobe light lense 64 in light communication between the strobe light means 60 and the external environment. As shown, the lense 64 has sealably mounted therein an antenna means 65 for conducting radio transmissions from the transmitter 61 to the external environment.

As shown in FIG. 9 the base 7 is provided with a leaf spring means 66 for maintaining the on-off switch 56 in an off position while the float means 3 is mounted on the base 7.

In FIG. 11 is shown a dome shaped buoyant float 76 without the signaling system mounted thereon for general use where the expense of the signaling system is not warranted. All other features of the Emergency Locator System are as previously described and as shown in FIG. 5.

Figure 4:
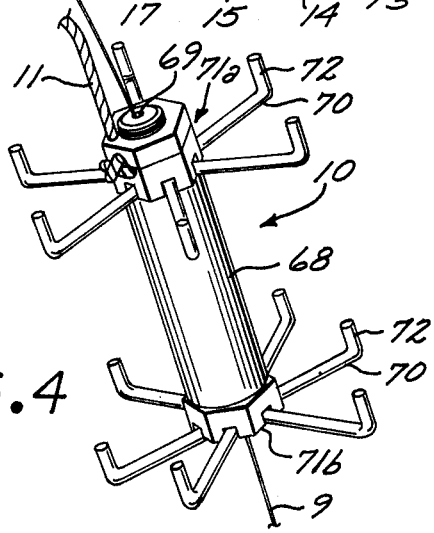
FIG. 4 is a perspective view of a grapple hook means.

FIG. 4 shows a novel grapple hook means 10 for use in retrieving sunken vessels 73 as part of the Emergency Locator System described herein. The grapple hook 10 shown comprises a solid cylindrical body 68 having a relatively small locator line guide hole 69 therethrough along a cylindrical longitudinal axis as shown. A plurality of hook members 70 extend outwardly from top and bottom cylindrical ends 71*a*, 71*b*. The hook members have end hook means 72 extending upwardly a relatively short distance for engaging with grapple cables 12 on a base 7 mounted on a sunken vessel 73 (FIG. 2). The grapple hook means has means for attaching a retrieval cable 11 at the top end 71*a* for pulling a hooked vessel to the surface.

The various component parts may be constructed of any suitable material. Plastics have been found most suitable for corrosion resistance and for ease of manufacturing the float and base parts. Those most suitable fall within the class consisting of ABS, the Styrene Group, Marbon, Cycloac, Poly carbamate, Lexan, and Merlon.

FIG. 2 shows an alternative method for retrieval of sunken vessels, particularly applicable where the vessel is in shallow water wherein a diver 78 may use the locator line 9 to guide himself down to the sunken boat 73 carrying with him a retrieval line 80 for attaching to the grapple cables 12 on the base.

I claim as my invention:

1. An Emergency Locator System for locating and retrieving sunken vessels and locating vessels in distress comprising in combination;

a base adapted to be mounted on an external surface of a vessel in spaced apart relationship thereto to permit air and water to flow between a base lower surface and the vessel external surface on which the base is mounted, said base further comprising a hydrostatic pressure sensing float holding and release means, having a pressure sensing flexible diaphragm member mounted on the base lower surface for actuating a float holding and release trigger means, said trigger means adapted to fixedly hold a buoyant marker float means releasably mounted on said base until said base having said float means mounted thereon becomes immersed in a fluid having a pressure greater than a pre-selected pressure below which the said diaphragm will not actuate the said trigger means, said pre-selected pressure being substantially greater than atmospheric pressures, whereupon said diaphragm actuates said float holding and release trigger means and the float means is released from said base and rises to the water surface, said base having one or more U-shaped grapple cables fixedly connected to a top surface of said base and being adapted further for being fixedly attached at cable ends to the vessel surface;

said buoyant marker float means adapted for releasably mounting on said base in spaced apart relationship for permitting air and water to circulate between base side and top surfaces and a float under side, said underside being adjacent to said base side and top surfaces when said float means is mounted on said base, said float means having a plurality of base float holding trigger means engaging shoulders for engaging said trigger means in releasably locked position when said float means is mounted on said base; and a locator line connecting said float means to said base for maintaining float to base connection when the float means is released from the base and rises to the water surface and for guiding a diver and a retrieving grapple hook means connected to a retrieval cable to the grapple cables for hooking a grapple hook means to said grapple cables.

2. An Emergency Locator System set forth in claim 1 wherein said base hydrostatic pressure sensing float holding and release means comprises a rigid waterproof hollow housing having a vertical side wall and a conical top wall having a conical height substantially smaller than a conical diameter thereof, said conical diameter being substantially larger than a side wall vertical height, said top wall being integral at a circumferential edge with a side wall upper edge, said housing being sealably closed at a side wall lower edge with said flexible diaphragm member thereby enclosing within the housing a pressure differentiating cavity, said housing wall having a relatively small pressure balancing hole therein communicating between the cavity and an ambient atmosphere external thereto, said diaphragm member having sealably and fixedly connected to a central portion thereof in axial alignment with a side wall central axis a float release trigger actuating piston shaft, said shaft extending vertically from said diaphragm along said axis through said cavity and sealably through a top wall piston shaft hole and further extending a relatively short distance above a housing top surface, said shaft having an upper end thereof fixedly connected to a float release trigger actuating piston, said piston having vertically pivotably mounted therein a plurality of float release trigger lever arms spaced approximately equidistantly around the piston, said arms extending outwardly from said piston in parallel relation to the housing top surface in said equidistant arrangement, said lever arms being vertically pivotably mounted in trigger lever arm pivot means, one for each arm, said pivot means being attached to the housing at or near a housing outer edge, each of said arms having a float release trigger control member extending downwardly from said trigger lever arm pivot means, said control member being integral with said trigger lever arm, said control member having at an end thereof a float release trigger, said control member and trigger in spaced apart relationship with respect to a housing vertical wall outer surface to permit locking engagement with said float holding trigger engaging shoulders, said triggers moving toward said housing vertical wall outer surface and into float unlocking position upon upward movement of the diaphragm occasioned by sufficient increase in ambient pressure, said cavity having therein a pressure depth-set means for pre-selecting a pressure below which the diaphragm will not actuate said piston shaft upwardly.

3. An Emergency Locator System as set forth in claim 2 wherein the pressure depth set means comprises a spring means for springingly maintaining substantially constant the distance between a diaphragm top surface and a housing top wall lower surface until a force exerted by said spring in so maintaining said distance constant is exceeded by an opposing force acting against a diaphragm lower surface.

4. An Emergency Locator System as set forth in claim 2 wherein said buoyant marker float means is dome-shaped and is adapted to mount loosely over said base housing in spaced apart relationship therewith having a first space between the housing top surface and a float underside sufficient for piston upward movement clearance and to contain said grapple cables in bent over position and having a second space between the housing vertical wall exterior surface and a float vertical wall interior surface sufficient to permit water to freely circulate in the said spaces when the float is mounted on the base and the base and float are submerged in water, and wherein said trigger engaging shoulders extend outwardly from the float vertical wall interior surface toward the housing vertical wall when the float is mounted on the base, said shoulders being spaced for alignment with said float holding and release trigger for mounting the float means in releasably locking engagement with said triggers when said float is mounted on said base.

5. An Emergency Locator System as set forth in claim 4 wherein said float means has a line retaining spool attached to a central portion of the float means underside for winding the locator line thereon, said line connecting the float means to the base.

6. An Emergency Locator System as set forth in claim 5 wherein the dome-shaped float means has a plurality of dye marker capsules embedded in the float underside, said capsules being sealed within water soluble enclosures, each of said capsules having enclosures requiring different periods for dissolving said enclosure ranging over a period from a few minutes to many hours thereby regulating the time of discharge of the dye permitting dye marker to be observable upon the float means surfacing in the water throughout the said period.

7. An Emergency Locator System as set forth in claim 5 wherein said base has a U-shaped leaf spring means having ends mounted on the base housing top surface in transverse relationship across a base central portion being located so as to not interfere with said trigger actuating piston, said spring having a vertex portion impinging across a central portion of the float means under side when said float means is mounted on said base, and wherein said float means has sealable mounted in a central portion of the underside an electrical circuit push button type on-off switch, said switch being closed when the push button is extended outwardly from the said float underside and open when the push button is depressed, said leaf spring for holding said switch in a depressed position when the float means is mounted on said base, said float means further having sealably attached to a central top float surface a signaling system housing means, said housing means enclosing a signaling system and a battery pack for operating said signaling system when the said on-off switch is in the on position.

8. An Emergency Locator System as set forth in claim 7 wherein the signaling system comprises a high intensity strobe light means enclosed within said signaling system housing, and wherein said housing means has sealably attached to a top surface thereof a strobe light lense, said lense in light communication with the strobe light means for transmitting light emitted from the strobe light means hemispherically into the atmosphere from the float means when floating on a water surface.

9. An Emergency Locator System as set forth in claim 8 wherein the signaling system further comprises in combination with said strobe light signaling means a VHF radio transmitter set to transmit continuously, when energized, an internationally recognized distress signal on an internationally recognized emergency frequency, said housing having extending upwardly sealably through a top portion of said housing a transmitter antenna, said antenna being electrically connected to transmitter output terminals.

10. An Emergency Locator System as set forth in claim 7 wherein the signaling system comprises a VHF radio transmitter set to continuously transmit, when energized, an internationally recognized distress signal on an internationally recognized Emergency frequency, said housing having extending sealably upwardly through a top surface thereof a transmitter antenna said antenna being electrically connected to transmitter output terminals.

11. An Emergency Locator System as set forth in claim 7 wherein said signaling system housing has sealably mounted in an external wall thereof an on-off switch for manually energizing and de-energizing said signaling system, said switch for test purposes and for permitting continuous operation of the signaling system without removing the float means from the base when needed by a vessel in distress said vessel not having sunk.

12. An Emergency Locator System as set forth in claim 1 wherein said grapple hook means comprises a cylindrical body having a relatively small centrally located line hole therein for enclosing therein a locator line and thereby guiding the said grapple hook means to a sunken vessel, said grapple hook means further having at a bottom end a plurality of outwardly extending bottom end hook members and at a top end a plurality of outwardly extending hook members, said hook members extending outwardly at substantially right angles with respect to a longitudinal axis of the cylindrical body, said hook members being substantially in equidistant spacing around the cylindrical body and being adapted to hook into one or more base grapple cables upon being guided to the base top surface, said top end further being adapted to fixedly connect a retrieval cable thereto, said grapple hook means being adapted to be lifted to the water surface carrying with it the sunken vessel upon having hooked the vessel as described.

* * * * *